United States Patent [19]

Schwing

[11] 4,191,513

[45] Mar. 4, 1980

[54] PUMP FOR CONVEYING CEMENT

[75] Inventor: Friedrich Schwing, Herne, Fed. Rep. of Germany

[73] Assignee: Friedrich Wilhelm Schwing GmbH, Herne, Fed. Rep. of Germany

[21] Appl. No.: 896,602

[22] Filed: Apr. 14, 1978

[30] Foreign Application Priority Data

Apr. 16, 1977 [DE] Fed. Rep. of Germany ..... 2716954

[51] Int. Cl.[2] ..... F04B 15/02

[52] U.S. Cl. ..... 417/517; 417/519; 417/532; 417/900

[58] Field of Search ..... 417/516, 517, 519, 532, 417/900; 137/625.21, 625.46

[56] References Cited

U.S. PATENT DOCUMENTS

| | | | |
|---|---|---|---|
| 3,398,693 | 8/1968 | Schumann | 417/517 X |
| 3,588,294 | 6/1971 | Schlecht | 417/900 X |
| 4,057,373 | 11/1977 | Schwing | 417/519 |

FOREIGN PATENT DOCUMENTS

| | | | |
|---|---|---|---|
| 2542066 | 2/1977 | Fed. Rep. of Germany | 417/900 |
| 795558 | 5/1958 | United Kingdom | 417/900 |

*Primary Examiner*—Richard E. Gluck
*Attorney, Agent, or Firm*—Remy J. VanOphem

[57] ABSTRACT

A pump for conveying cement comprises two pump cylinders and reciprocating pistons, an input container, a multi-limb oscillating shutter valve arranged in front of the pump cylinders and below the input container, the housing of the valve including a suction connection leading from the input container, two ports connected to the pump cylinders respectively, and an outlet located in the end wall of the housing. Two inlet ports are provided in the housing for placing the suction connection in communication with the ports connected to the pump cylinders respectively. The oscillating shutter is mounted on a horizontal shaft to be movable between two positions, and includes two control limbs, each controlling a different one of said inlet ports, and an outlet control limb the forward edge of which passes over and controls said outlet.

4 Claims, 4 Drawing Figures

PUMP FOR CONVEYING CEMENT

BACKGROUND OF THE INVENTION

1. Field of the Invention

The invention relates to a pump for conveying cement, of the kind having a number of pump cylinders and reciprocating pistons, an input container and a multi-limb oscillating shutter valve arranged in front of the pump cylinders and below the input container, the housing of which valve features two pressure inlet ports connected alternately to the associated pump cylinders respectively, an outlet and a suction inlet, the multi-limb oscillating shutter being arranged on a horizontal shaft to be movable between two positions and having a lower outlet control limb passing over the outlet.

2. Description of the Prior Art

Because of the properties of cement, cement pumps suffer to a relatively large extent from the danger of interruptions in delivery. For this reason, in particular, measures must be adopted with the oscillating shutter valve to prevent gradual blocking of the valve ways with setting cement. Furthermore, such pumps must often be installed on vehicles. Thus, a compact construction of the oscillating shutter valve is necessary.

A cement pump is known the valve of which features a two-limbed oscillating shutter the limbs of which are so compact that the rear edges of the oscillating limbs running transversely to the axis of the shaft pass by one or other of inlet ports in the rear side of the housing on changing position as shown in U.S. Pat. No. 4,057,373. An oscillating shutter of this kind has a relatively low-profile construction and has also the advantage that the deflection of the stream of delivered material, as it passes from the respective pressurizing cylinder into the outlet arranged in the end wall of the housing, is small. Thus, the desired low resistances to flow can be be achieved. It is, however, a disadvantage that the pressure channel enclosed by the two limbs, as has been shown in practice with such a pump, forms partial cross-sections which are not, or only inadequately, subjected to flow. Delivery interruptions are traceable back to this, brought about by gradual blocking of the pressure channel by setting cement.

Furthermore, a cement pump is known of the kind first referred to in U.S. Pat. No. 3,588,294 . In this pump, the inlet ports are in the end wall of the housing, the outlet must, on the other hand, be arranged in the floor of the housing so that the two-limbed oscillating shutter passes by this port with the longitudinal edge of its output control limb parallel to the axis of the shaft, and the other control limb can control an inlet port arranged below the input container, on changing position. With this design, very abrupt deflections are produced with very small radii of curvature, especially for the stream of cement coming from the delivery cylinder and arriving in the outlet and for diverting of this stream from the outlet into the connecting end of the delivery pipe.

Furthermore, there results from this a low floor clearance because the oscillating shutter valve housing stands relatively high, owing to the deep position of the delivery pipe connection in the floor of the housing.

If the outlet port is arranged on the end wall of the housing of a two-limbed oscillating shutter of this type, then a considerable increased constructional height results because the angle of swing of the oscillating shutter must not be too large and, for this reason, its pivot axis has to be moved upwards. Because of this, however, the radial extension of the oscillating shutter limbs is correspondingly increased, which applies to the limbs controlling the outlet port and the inlet port, so that the constructional height is doubly increased.

In a further known design (German Pat. No. 1,945,483), for avoidance of the increased constructional height of a two-limbed oscillating shutter, the two limbs are angled towards each other and the outlet port is at least partly arranged in the end wall of the housing. This design has, however, the same disadvantages described earlier, as the designs with one pressure channel.

The essential task of the invention is to effect the control of the flow of cement with a oscillating shutter valve whose flow paths are subjected to flow alternately with cement under suction and pressure and with which the possibility is provided of keeping the constructional height of the valve housing, as well as the height of the input container, low.

SUMMARY OF THE INVENTION

According to the invention, there is provided a pump for conveying cement comprising two pump cylinders and reciprocating pistons, an input container, a multi-limb oscillating shutter valve arranged in front of the pump cylinders and below the input container, the housing of the valve including a suction connection leading from the input containers, two ports connected to the pump cylinders respectively, and an outlet located in the end wall of the housing, there being provided two inlet ports for placing said suction connection in communication with said ports connected to the pump cylinders respectively, the oscillating shutter being mounted on a horizontal shaft and movable between two positions and including two control limbs each controlling a different one of said inlet ports and an outlet control limb the forward edge of which passes over and controls said outlet.

By increasing the number of limbs of the oscillating shutter valve to three, on the one hand a suction port can be associated with each cylinder and, on the other hand, between the outlet control limb and one of the two further control limbs, a pressure channel can be formed, respectively. These pressure channels are each associated with a different one of the two inlet ports and subjected to flow from the material delivered on the pressure stroke with the inlet port closed, while after the positional change of the oscillating shutter, they are subjected to flow from the material under suction. On the other hand, the two additonal limbs controlling the inlet ports shorten the swivel path and enable the shaft to be located at a higher level without increasing the overall height of the input container. For this reason the forward edge of the outlet control limb can pass by the outlet and it can be located higher, so that the delivery paths are made straighter, particularly on the pressure stroke.

Thus, the invention offers advantages which result from two inlet ports which are adequately large and are arranged side-by-side above the delivery cylinder, and from the described straightening of the delivery paths. There exists furthermore the possibility of guiding the suction and pressure streams in the rotatable-shutter valve around a maximum of a quarter arc. Together with the considerable reduction of the flow resistances made possible by this, there also results a surprising scouring effect. Because the two channels, each enclosed by two limbs in one position of the valve are a suction cavity and, in the following position, a pressure cavity, they are continuously scoured. The danger of interruptions to delivery is to a great extent avoided by this.

Preferably, and according to a further embodiment of the invention, the axis of the oscillating shutter shaft is positioned parallel to the pump cylinders, arranged alongside each other, and above the centers of the cylinders and is also located above the inlet end of a delivery pipe in communication with said outlet, as well as being below the input container. By this, a relatively small pivot angle resulted approximately 45°. This has the advantage of relatively short switch-over times resulting in quicker changing of the delivery paths whose immediate closing off is essential, especially when conveying to a height, considering the danger of the cement running back out of the delivery pipe. It is also an advantage that the outlet arranged in the front wall may feature a relatively large opening, whereby flow resistances are further reduced.

BRIEF DESCRIPTION OF THE DRAWINGS

Further characteristics and other advantages of the invention will emerge from the following description of an embodiment of the invention, reference being made to the accompanying drawings in which.

DESCRIPTION OF THE PREFERRED EMBODIMENT

Figure 1:
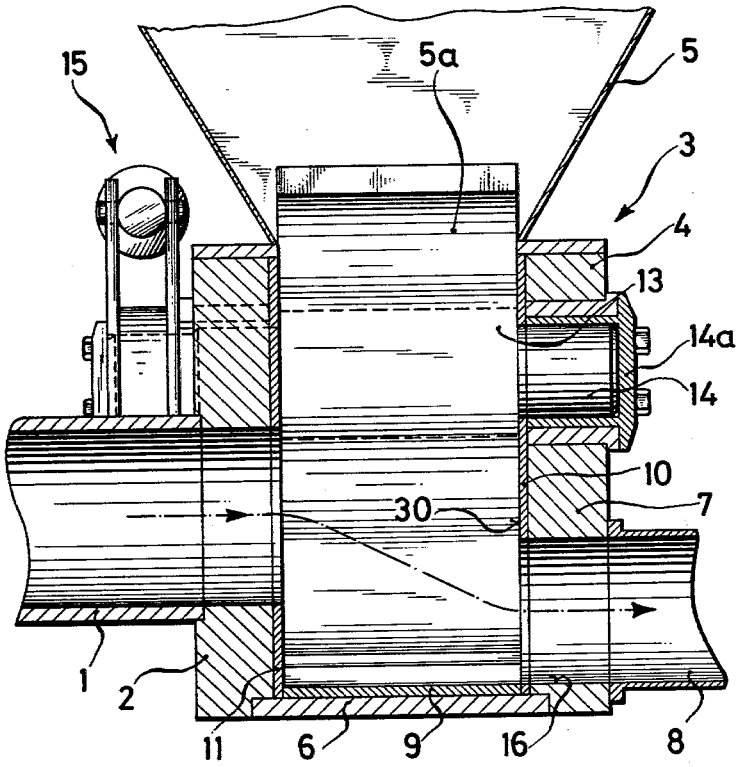
FIG. 1 shows the front end of a cement pump in longitudinal section, taken along the line I—I of FIG. 2.

According to the embodiment represented, the forward ends of two delivery cylinders 1, 35 communicate with ports 34 and 33 respectively in the rear wall 2 of the housing of a oscillating shutter valve indicated generally at 3. On an upper flange 4 of the housing sits a funnel-shaped input container 5. The housing has a bottom wall 6 as well as a front wall 7 formed with an outlet port 16 which registers with the inlet end of a delivery pipe 8. Wear plates 9, 10 and 11 line the inner cavity of the housing in which a oscillating shutter, generally indicated at 13, can swing.

The oscillating shutter 13 is mounted on a shaft 14 for which a bearing **14*a* is provided in the front wall 7 of the housing. A drive 15**, not shown in detail, serves for movement of the oscillating shutter into one or another of two control positions.

Figure 2:
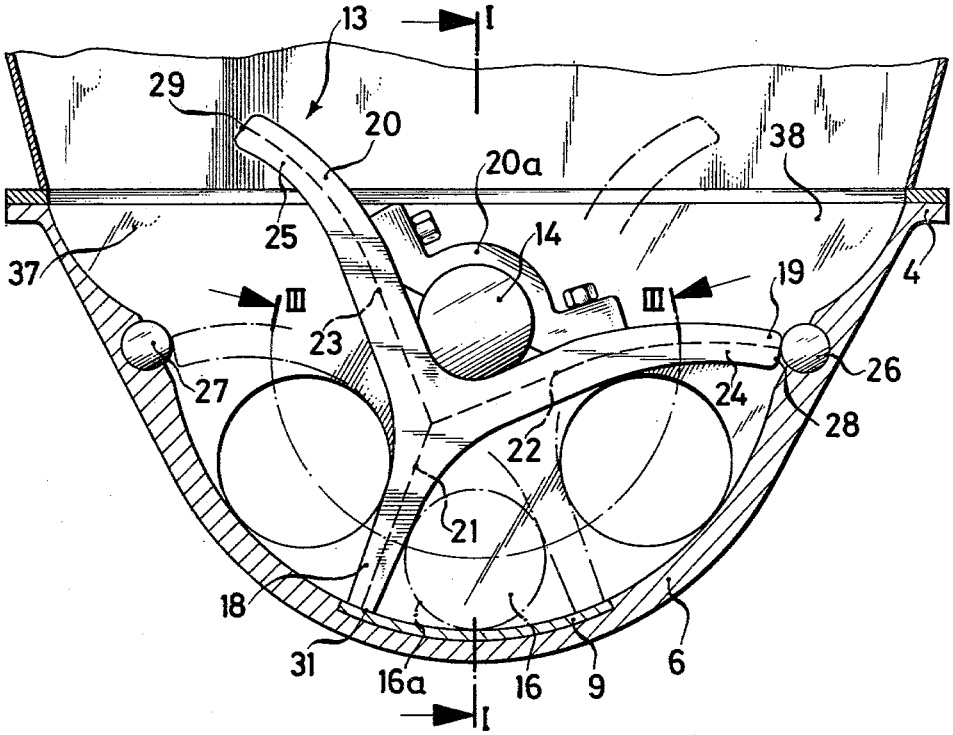
FIG. 2 is a cross-section through the pump of FIG. 1.

These two control positions are shown in FIG. 2, wherein one position is shown in solid lines and the other position in chain lines. Also shown in chain lines at **16*a* is the position of the outlet port 16. The oscillating shutter 13 comprises a lower limb 18 controlling the outlet 16. This forms with two further control limbs 19 and 20 a unit which is fixed onto the shaft 14, by means of a screwed-on bush 20*a***, so that it cannot be turned relative to the shaft.

Each control limb has a central plane 21, 22, 23 shown in dashed lines. The central plane 21 of the control limb 18 is flat and encloses an angle of about 135° with the central planes 22 and 23 of the two control limbs 19 and 20. The outer ends of the central planes 22 and 23 of the control limbs 19 and 20, as shown at 24 and 25, are curved downwardly, i.e. in the direction of the outlet control limb 18.

Inside the housing are sealing strips 26 and 27, which co-operate with the end edges 28 and 29, respectively, of the control limbs 19 and 20. In the position shown in solid lines in FIG. 2, the end edge 28 of the control limb 19 contacts the strip 26, while after positional change of the shutter 13, the end edge 29 of the control limb 20 rests on the sealing strip 27. During the change of position of the shutter, the front edge 30 (see FIG. 1) of the outlet control limb 18 passes over the outlet port 16. The longitudinal edge 31 of the limb 18 passes over the wear plate 9 on the bottom wall 6 of the housing.

Figure 3:
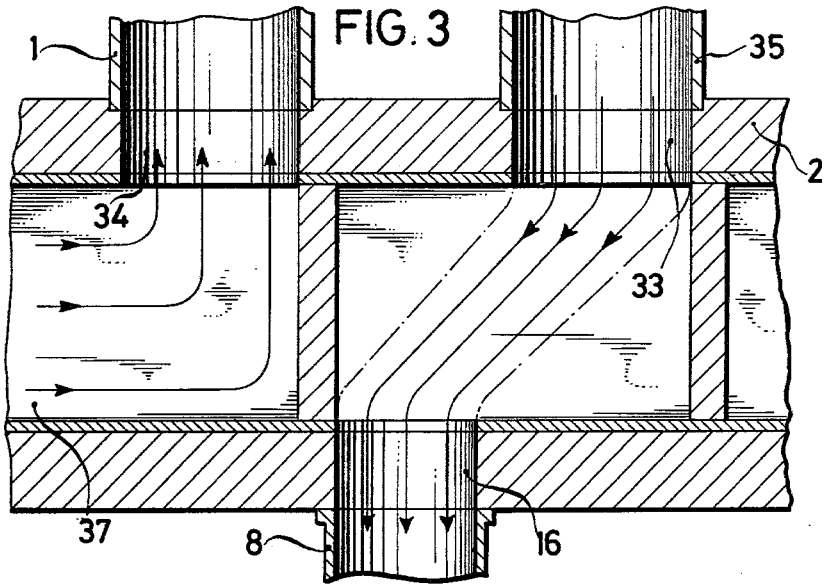
FIG. 3 is a section along the line III—III of FIG. 2.
Figure 4:
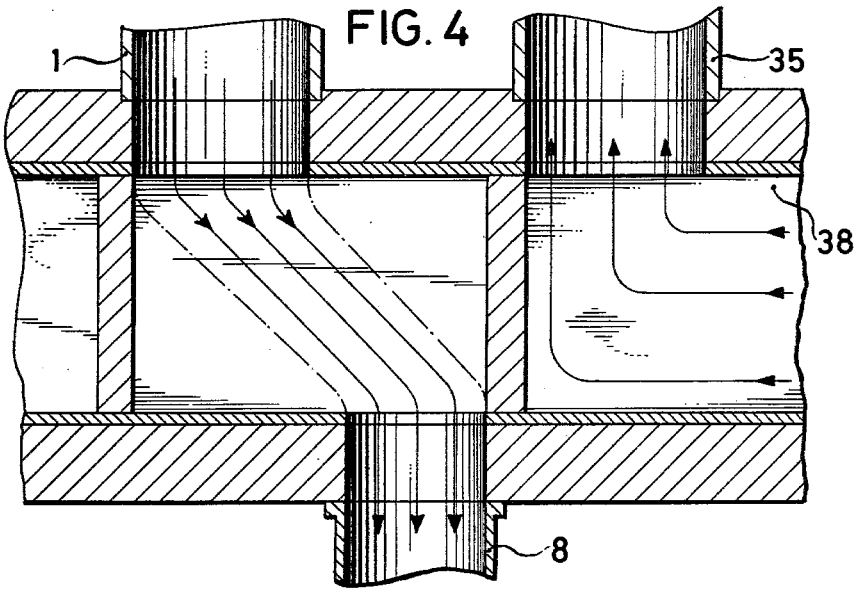
FIG. 4 is a similar view to FIG. 3 after change of position of the oscillating shutter valve.

From FIGS. 3 and 4, it may be seen that the described oscillating shutter valve 13 operates between the two ports 33 and 34 formed in the housing rear wall 2 which respectively co-operate with the front ends of the pump cylinders 1, 35. The ports 33 and 34 are also controlled by the oscillating shutter, like the outlet port 16 for the delivery pipe 8, and also two further ports 37 and 38, of which one of each is shown in FIGS. 3 and 4, whose positions, moreover, can also be seen in FIG. 2. The ports 37 and 38 are inlet ports which are each controlled, to be open or shut, by one of the two control limbs 19 and 20. The ports 37 and 38 lie above the pressure ports 34 and 33 respectively, and are subjected to flow with the suction strokes of the associated pump cylinders 1, 35 respectively. This case is shown schematically in FIG. 3 for the inlet port 37 and, in FIG. 4, for the inlet port 38.

During the suction stroke of each cylinder 1 or 35, a pressure stroke of the other cylinder is carried out, so that cement can arrive in the delivery pipe 8 from the respective delivering cylinder.

As also can be seen from FIG. 2, the axis of the rotatable shaft 14 is arranged parallel to the pump cylinders 1, 35, which are arranged alongside each other, and above the centers of the cylinders. The inlet end of the delivery pipe 8 is in register with the outlet 16, as well as being below the input container 5 the lower opening of which forms the suction connection indicated at **5*a***.

I claim:

1. A reciprocating piston pump for conveying cement comprising two pump cylinders; an input container; a multi-limb oscillating shutter valve mounted on a horizontal shaft and arranged in front of the pump cylinders and below the input container; a housing for the oscillating shutter valve, said housing having an end wall, at least two ports and a suction connection in the housing leading from the input container, said at least two ports in the housing connected to the pump cylinders respectively; an outlet located in the end wall of the housing; and two inlet ports in the housing for placing said suction connection in communication with said ports connected to the pump cylinders respectively; said oscillating shutter being movable between two positions and including two inlet control limbs each controlling a different one of said inlet ports and an outlet control limb the forward edge of which passes over and controls said outlet.

2. A pump for conveying cement according to claim 1, wherein the axis of the shaft of the oscillating shutter is arranged parallel to the pump cylinders, which are arranged alongside each other, and above the centers of the cylinders, and is also located above the inlet end of a delivery pipe in communication with said outlet, as well as being below the input container.

3. A pump for conveying cement according to to claim 1, wherein the central planes of the inlet control limbs are at an angel of about 135° with the central plane of the outlet control limbs and the ends of the central planes of the inlet control limbs associated with the inlet ports are curved downwardly in the direction of the outlet control limb.

4. A pump for conveying cement according to claim 1, wherein the oscillating shutter oscillates through an angle of about 45°.

* * * * *

UNITED STATES PATENT AND TRADEMARK OFFICE

CERTIFICATE OF CORRECTION

PATENT NO. : 4,191,513
DATED : March 4, 1980
INVENTOR(S) : Friedrich Schwing

It is certified that error appears in the above-identified patent and that said Letters Patent are hereby corrected as shown below:

Column 2, line 65 delete the word "rotatable-" and insert ----oscillating----.

Column 3, line 14 delete the word "resulted" and insert ----results----.

Signed and Sealed this

*Twenty-sixth* Day of *August 1980*

[SEAL]

*Attest:*

SIDNEY A. DIAMOND

*Attesting Officer*

*Commissioner of Patents and Trademarks*

UNITED STATES PATENT OFFICE

CERTIFICATE OF CORRECTION

Patent No. 4,191,513 Dated March 4, 1980

Inventor(s) Friedrich Schwing

It is certified that error appears in the above-identified patent and that said Letters Patent are hereby corrected as shown below:

Column 5, line 4, delete the word "angel" and insert ----angle----.

Signed and Sealed this

Sixteenth Day of June 1981

[SEAL]

Attest:

RENE D. TEGTMEYER

Attesting Officer

Acting Commissioner of Patents and Trademarks